US007765845B2

(12) United States Patent
Nakano et al.

(10) Patent No.: US 7,765,845 B2
(45) Date of Patent: Aug. 3, 2010

(54) STEM SLIDE DEVICE

(75) Inventors: Koji Nakano, Ube (JP); Takeharu Yamamoto, Ube (JP)

(73) Assignee: Ube Machinery Corporation, Ltd. (JP)

( * ) Notice: Subject to any disclaimer, the term of this patent is extended or adjusted under 35 U.S.C. 154(b) by 59 days.

(21) Appl. No.: 12/095,744

(22) PCT Filed: Dec. 8, 2006

(86) PCT No.: PCT/JP2006/325005

§ 371 (c)(1),
(2), (4) Date: Jun. 2, 2008

(87) PCT Pub. No.: WO2007/069708

PCT Pub. Date: Jun. 21, 2007

(65) Prior Publication Data

US 2009/0266133 A1 Oct. 29, 2009

(30) Foreign Application Priority Data

Dec. 12, 2005 (JP) ..... 2005-357903

(51) Int. Cl.
*B21C 25/00* (2006.01)

(52) U.S. Cl. ..... 72/273; 72/253.1; 72/270

(58) Field of Classification Search ..... 72/253.1, 72/263, 270, 273

See application file for complete search history.

(56) References Cited

U.S. PATENT DOCUMENTS

| | | | | |
|---|---|---|---|---|
| 2,188,076 | A * | 1/1940 | Dinzl | 72/21.2 |
| 3,306,089 | A * | 2/1967 | Brayman | 72/56 |
| 4,342,212 | A * | 8/1982 | Sibler | 72/255 |
| 4,785,652 | A | 11/1988 | Stewart | |
| 5,247,821 | A | 9/1993 | Bertoli | |
| 5,335,528 | A | 8/1994 | Cristiani | |

FOREIGN PATENT DOCUMENTS

| | | | |
|---|---|---|---|
| JP | 49-9035 | B1 | 3/1974 |
| JP | 2-500008 | A | 1/1990 |
| JP | 4-231110 | A | 8/1992 |
| JP | 5-237539 | A | 9/1993 |
| JP | 8-206727 | A | 8/1996 |

* cited by examiner

*Primary Examiner*—Edward Tolan
*Assistant Examiner*—Stephanie Jennings
(74) *Attorney, Agent, or Firm*—DLA Piper LLP (US)

(57) ABSTRACT

The stem slide device of the present invention in an extruder has a stem vertical movement support (71) and slide guide members (72-1, 2) fastened to the support and forming guide grooves. A stem (6) pushing against a billet loaded in a container is held at the slide table (73) horizontally. The slide table slides in the vertical direction along the vertical face of the support. When the slide table is positioned at the bottom end of the guide groove, the hydraulic cylinders (77-1, 2) are driven so that the rods (78-1, 2) push the back surface of the slide table against the vertical face of the support. Therefore, the axis of the stem is held matched with the axis of the container.

5 Claims, 5 Drawing Sheets

STEM SLIDE DEVICE

TECHNICAL FIELD

The present invention relates to a stem slide device provided in an extrusion press, more particularly relates to a stem slide device enabling a stem slide table to which a stem pushing against a billet loaded in a container is horizontally attached to be raised at the time of supply of a billet.

BACKGROUND ART

In general, when extruding a billet made of a metal material, for example, a material of aluminum or its alloy etc. by an extrusion press, a stem is attached to a front end of a main ram driven by a hydraulic cylinder, a container is pushed against the die, and, in that state, the billet on the billet loader is pushed by the stem of the front end of the main ram to fill it into the billet holding part of the container. Further, by making the main rain advance by further drive of the hydraulic cylinder, the billet is strongly pushed by the stem. Therefore, a shaped product is pushed out from the outlet of the die.

In this conventional type extrusion press, when loading a billet in the container, the front end of the stem must be retracted by the amount of the length of this billet. The stroke of the main ram becomes the billet length plus the length of the stem. Therefore, to secure the stroke of this main ram, the conventional type extrusion press ends up becoming larger as a whole. The hydraulic cylinder driving the main ram also becomes enlarged. Along with this, the amount of oil used for the working process has to be increased.

In recent years, extrusion presses are being made more compact. Due to this increasing compactness, space spacing and energy saving can be achieved in extrusion presses. An extrusion press called a "short stroke press system", one technique for increasing the compactness, is being developed. In a conventional type of extrusion press, space for supply of the billet is required for loading the billet into the container. The stroke of the main ram became longer by exactly this amount of length. Therefore, in this short stroke press system, the method of supplying the billet is specially designed so as to shorten the length of the main stroke by exactly the amount of length of the space for billet supply.

According to this short stroke press system, the extrusion press as a whole can be made shorter in length and more compact, the nonextrusion time (idling time) can be shortened, and, furthermore, the amount of working oil of the hydraulic cylinder for driving the main ram can be reduced. As a result, space saving and energy saving of the extrusion press can be achieved.

This short stroke press system is divided into two types by the direction of supply of the billet with reference to the container. One system is a short stroke press system called the "front loading type". This front loading type makes the container move to the stem side at the time of supplying a billet and thereby secures space for the supply of the billet at the die side due to the position of the container after movement. That is, the billet is supplied between the die and the front end of the stem.

In this front loading type press system, the billet is supplied by charging in the air, so maintenance of the centering precision of the billet loader becomes important and thus maintenance and control of the billet loader become necessary. Further, precision of the billet diameter, bending, end face, etc. is also required. Therefore, in practice, this is dealt with by enlarging the inside diameter of the container. However, increasing the inside diameter becomes a major cause of blisters in the product.

On the other hand, another system is, for example, proposed in Japanese Patent Publication (A) No. 4-231110, Japanese Patent Publication (A) No. 8-206727, etc. This system is a short stroke press system called the "rear loading type" as shown in FIG. 4. In this rear loading type, the stem is made to move horizontally or rise to secure the space for supplying the billet at the time of supplying the billet. By making the stem move in the horizontal direction or above from the initial position of the stem, a space for supplying the billet is formed at the stem side of the container at the side of or below the stem. A billet is supplied to this space.

However, in an extrusion press of the rear loading type short stroke press system, when employing the above-mentioned stem rising movement mechanism, the stem slide table supporting the stem vertically moves while sliding along the inside of a slide groove formed in the stem vertical movement support, so there was the problem of seizing between the liner applied to the slide groove and the stem slide table. When seizure occurred, it was necessary to stop the extrusion press and replace the liner. There was the problem that the facility was idled each time replacing the part.

Further, the stem slide table supports the heavy stem in a cantilever manner, so entire surface of the stem slide table does not uniformly slide with the liner of the slide groove. Therefore, a pushing force is created at particular parts of the top end and bottom end of the stem slide table. This uneven pushing force causes the stem slide table to easily partially wear down. For this reason, when the stem slide table is at the descent limit, the axis of the stem no longer matches with the axis X of the billet holding part of the container.

When in such a state, making the axis of the stem match the axis X of the billet holding part of the container is extremely difficult, so the stem slide table itself is replaced. This replacement leads to swelling costs. Further, the extrusion press facility must be stopped for the replacement. There were therefore the problem of the facility being idled and the problem of the work for centering the container and stem (work for matching the axis X) being troublesome and time consuming.

Therefore, the present invention has as its object the provision of a stem slide device eliminating slide rattling between a stem slide table to which a stem for pushing a billet loaded into a container is attached horizontally and a slide groove provided in a stem vertical movement support, preventing seizure between the stem slide table and stem vertical movement support, reducing the frequency of replacement of parts, simplifying the centering work, and enabling the stem to be raised at the time of supplying a billet.

SUMMARY

The stem slide device of the present invention is provided with a stem slide table to which a stem pushing a billet loaded in a container is horizontally attached, a slide guide member attached to a stem vertical movement support and forming a guide groove with which a side end of the stem slide table is engaged and slides up and down, and a lock unit provided at the slide guide member and pushing the side end of the stem slide table, when the stem slide table is positioned at a bottom end of the guide groove, the lock unit is driven to lock the stem slide table, and the stem is held at a position of an axial line of the container.

Further, the guide groove is formed by the inner surface of the slide guide member and wall surface of a stem vertical movement support attaching the stem slide table. The side end of the stem slide table slides between the inner surface and the wall surface, the side end of the stem slide table is pushed by the lock unit against the wall surface of the stem vertical movement support, and furthermore liners are applied to the inner surface of the slide guide member and the wall surface of the stem vertical movement support.

Further, the side end of the stem slide table slides along the wall surface of the stem vertical movement support and is provided with a liner member elastically held in a direction pushing against the wall surface.

When the lock unit is driven, the liner member is pushed by the wall surface of the stem vertical movement support, whereby the back surface of the stem slide table abuts against the wall surface of the stem vertical movement support.

In the above way, according to the stem slide device of the present invention, the side end of the stem slide table to which the stem pushing against a billet loaded in a container is attached horizontally is pushed against by the drive operation of the lock means when the stem slide table is positioned at the bottom end of the guide groove of the stem guide member, so when returning the stem to the billet extruding state after making the stem move vertically, the reproducibility of the stem centering in the billet holding part of the container can be secured.

Further, the side end in the stem slide table to which the stem is attached slides along the wall surface of the stem vertical movement support and is provided with a liner member elastically held in a direction pushing against the wall surface, so this elastic held liner member serves as a mechanism sticking out with respect to the stem vertical movement support, suppresses rattling in sliding of the stem slide table, and, furthermore, enables the formation of clearance between the stem slide table and stem vertical movement support, so prevents seizure.

BRIEF DESCRIPTION OF THE DRAWINGS

The present invention will be explained below while referring to the attached drawings, wherein.

EMBODIMENTS OF THE INVENTION

Next, embodiments of a stem slide device of the present invention will be explained, but the stem slide device of the present invention is based on application to an extrusion press of the above-mentioned rear loading type short stroke press system, so to make the characterizing features of the stem slide device of the present invention clearer, before explaining the embodiments of the present invention, an extrusion press of the rear loading type short stroke press system will be explained below with reference to FIG. 4 to FIG. 7.

Figure 4:
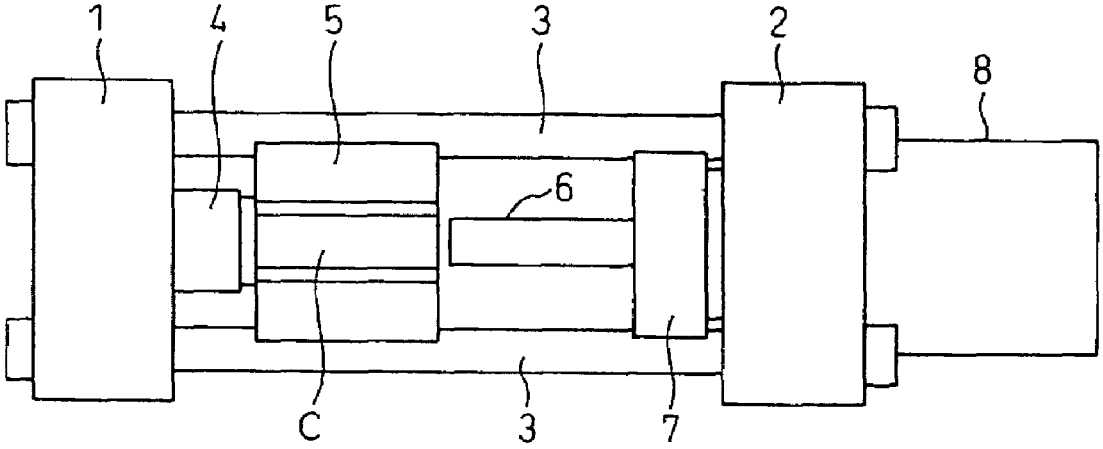
FIG. 4 is a view for explaining the configuration of a rear loading type extrusion press.

FIG. 4 shows an outline of an extrusion press employing the rear loading type short stroke press system. The configuration as seen from above the extrusion press is shown. In this extrusion press, an end platen 1 and a cylinder attaching block 2 are connected and fastened by tie rods 3. The end plate 1 has attached to it a die 4 having a shape for extruding a billet into a product. Against this die 4, a container 5 provided with a billet holding part C is pushed.

Further, the cylinder attaching block 2 has a main hydraulic cylinder 8 attached to it to make the stem 6 move along the axis of the billet holding part C of the container 5. While not shown, inside the main hydraulic cylinder 8, a main ram driven by hydraulic pressure is arranged. The front end of this main ram has a stem support member 7 attached to it. This stem support member 7 has a stem 6 attached to it. When the main ram of the main hydraulic cylinder is driven, the stem 6 is moved along the center axis of the billet holding part C of the container 5. Note that in FIG. 4, illustration of the mechanisms for horizontal movement or rising movement of the stem at the time of supply of a billet is omitted.

Figure 5:
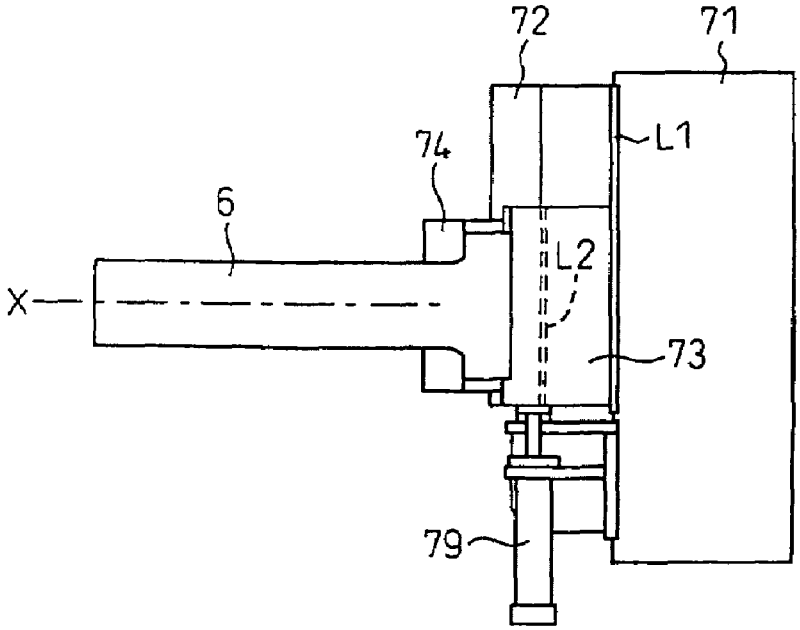
FIG. 5 is a view for explaining the configuration of a stem slide in a rear loading type extrusion press.

Therefore, an example of the rising movement mechanism of the stem used for the extrusion press of the rear loading type short stroke press system of FIG. 4 is shown in FIG. 5. Here, the stem support member 7 shown in FIG. 4 is comprised of a stem vertical movement support 71, slide guide member 72, stem slide table 73, and, further, stem clamp members 74. The slide guide member 72 is fastened to the stem vertical movement support 71 and is provided with a slide groove through which the two side ends of the stem slide table 73 can slide vertically.

The stem base of the stem 6 is clamped to the stem slide table 73 by the stem clamp members 74 whereby the stem 6 is supported while held horizontal. Furthermore, the stem slide table 73 is moved vertically by operation of a stem vertical drive hydraulic cylinder 79. While not shown, a mechanical stopper for setting a descent limit of the stem slide table 73 is provided. A digital proximity sensor of this mechanical stopper detects whether the vertical center of the stem is within an allowable value. FIG. 5 shows the state where the stem slide table 73 is at the descent limit. The center of the stem 6 matches with the axis X of the billet holding part C of the container 5.

Figure 6A:
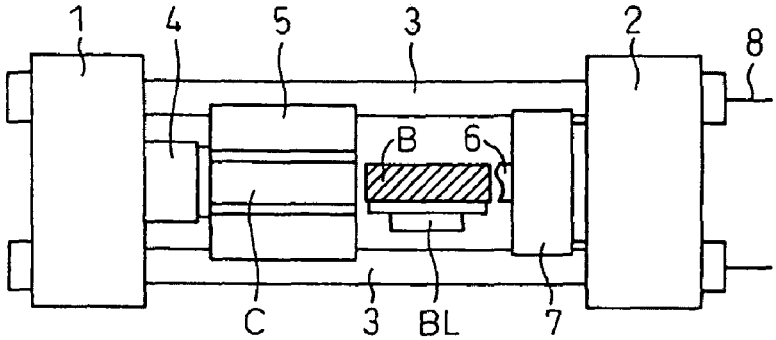
FIGS. 6A to 6C are views for explaining the supply and insertion of a billet in the rear loading type extrusion press shown in FIG. 4.
Figure 6B:
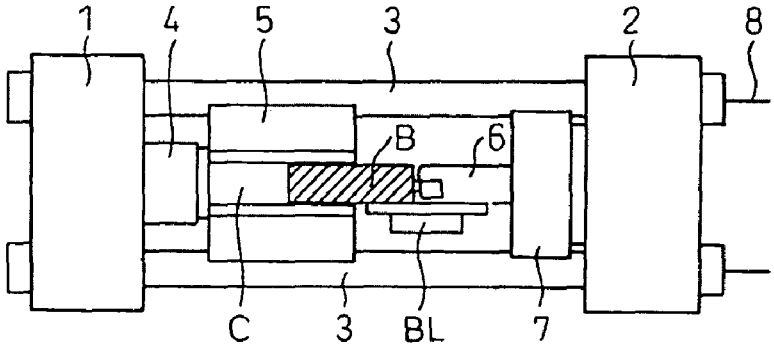
Figure 6C:
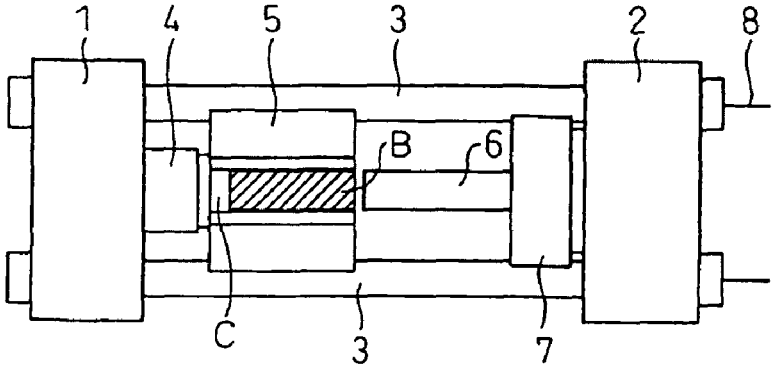

Next, referring to FIG. 6A to FIG. 6C, the billet supply operation of an extrusion press of the rear loading type shown in FIG. 4 will be explained. In FIG. 6A to FIG. 6C, parts the same as the extrusion press of FIG. 4 are assigned the same notations.

Figure 7:
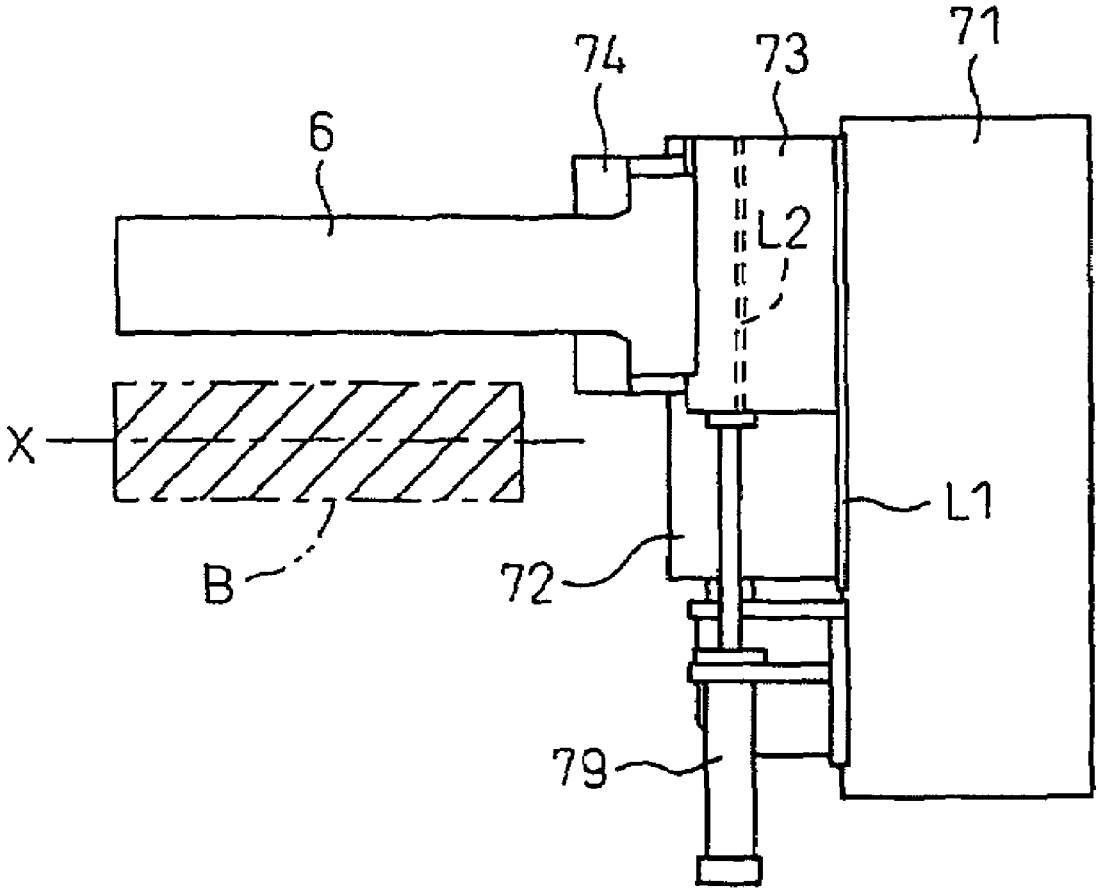
FIG. 7 is a view for explaining a stem rising position at the time of supply of a billet shown in FIG. 6A.

First, as shown in FIG. 6A, the stem 6 is moved to rise. In the space formed below it, a billet B held in the billet loader BL is supplied to the axial position of the billet holding part C of the container 5 from the side of the extrusion press. Here, the state of rising movement of the stem is shown in FIG. 7. The rising movement mechanism of the stem shown in FIG. 7 is similar to FIG. 5. The same parts are assigned the same reference notations.

In FIG. 7, the stem vertical drive hydraulic cylinder 79 operates whereby the stem slide table 73 is pushed up from the position of the descent limit to a predetermined height. This being the case, due to the rising movement of the stem slide table 73, the stem 6 clamped to it also is moved to rise from the position of the axis X to a predetermined height. Therefore, after the stem 6 rises, a space is formed at the position of the axis X. This space may, as illustrated, be supplied with the next ejected billet B.

Next, as shown in FIG. 6B, a billet insertion device provided at a billet loader BL is driven in its axial direction whereby the billet B is inserted and loaded into the billet holding part C of the container 5.

As shown in FIG. 6C, when the billet B is further inserted and finishes being loaded into the billet holding part C, the billet loader BL is retracted from the extrusion press to the side and the operation for holding the next billet: is shifted to. After this, the raised stem 6 is driven to descend and is returned to the initial axial position of the billet holding part C. Then, the main hydraulic cylinder 8 is driven and the main ram advances, whereby the stem 6 starts to push against the billet B, then the billet B is extruded by the die 4.

In the stem slide device in the extrusion press in which the above explained rear loading type short stroke press system is employed, there are the problems explained above, so the stem slide device of the present invention is provided with a stem slide table to which a stem for pushing a billet loaded in a container is attached horizontally and a slide guide member attached to the stem vertical movement support and forming a guide groove to which a side end of the stem slide table is engaged and slides up and down, a lock means for pushing against a side end of the stem slide table is provided at the slide guide member, and further the side end of the stem slide table being provided with a liner member sliding along the wall surface of the stem vertical movement support and elastically held in a direction pushing against the wall surface. Due to this configuration, slide rattling between the stem slide table and the slide groove provided at the stem vertical movement support is eliminated, seizing between the stem slide table and stem vertical movement support is prevented, the frequency of replacement of the parts can be reduced, and the centering work is simplified.

Next, while referring to FIG. 1 to FIG. 3, an embodiment of the stem slide device of the present invention will be explained. The stem slide device of the present invention is based on application to an extrusion press of the above-mentioned rear loading type short stroke press system. The stem slide device is similar in basic configuration to the stem slide device shown in FIG. 5 and FIG. 6.

Figure 1:
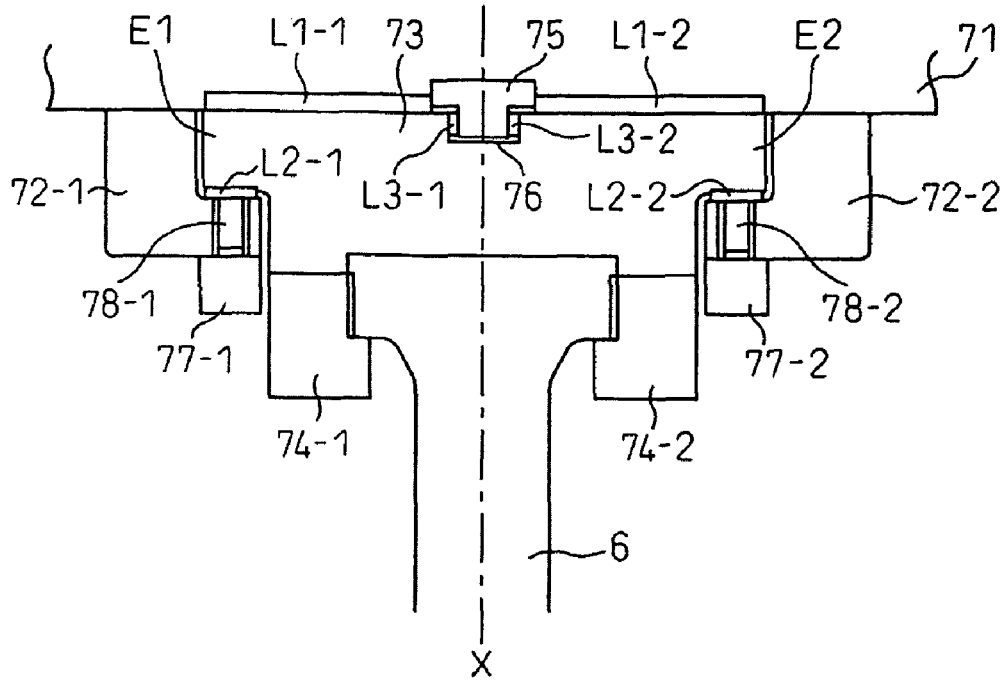
FIG. 1 is a view explaining a first embodiment of a stem slide device in an extrusion press according to the present invention.

FIG. 1 shows a first embodiment of a stem slide device of the present invention. The stem slide device of the first embodiment shown in FIG. 1 is expressed by the horizontal cross-section at the position of the stem shaft of the stem slide device shown in FIG. 5.

The stem slide device shown in FIG. 1 is basically configured from a stem vertical movement support 71, slide guide members 72-1 and 72-2, a stem slide table 73, and, further, stem clamp members 74-1 and 74-2. The slide guide members 72-1 and 72-2 were fastened to the stem vertical movement support 71. A slide groove is formed between the slide guide members 72-1 and 72-2 and the liners L1-1 and L1-2 given to the stem vertical movement support 71. The inside of this slide groove is designed so that the two side ends E1 and E2 of the stem slide table 73 can slide in it up and down.

The stem base of the stem 6 is clamped at the stem slide table 73 by the stem clamp members 74-1 and 74-2 whereby the stem 6 is supported held horizontally. Furthermore, the stem slide table 73, while not shown, in the same way as the case of FIG. 5, is moved vertically by operating of the stem vertical drive hydraulic cylinder 79 (direction perpendicular to paper surface of FIG. 1). A mechanical stop is also not shown, but in the same way as in the case of FIG. 5, is provided for setting the descent limit of the stem slide table 73.

Further, the stem vertical movement support 71 is provided with a guide key 75 extending in the vertical direction. This guide key 75 guides the stem 6 upward along the axis X of the billet holding part C of the container. A key groove 76 sliding along this guide key 75 is provided at the surface of the stem slide table 73 at the side opposite to where the stem is attached. By this key groove 76 engaging with and being guided by the guide key 75, even if the stem 6 moves vertically, the axis of the stem 6 can be kept constant in the horizontal direction position of the axis X without shaking horizontally with respect to the axis X of the billet holding part C of the container.

Note that liners L2-1 and L2-2 are provided between the side ends E1 and E2 and the slide guide members 72-1 and 72-2 of the stem slide table 73. The key groove 76 provided at the stem slide table 73 is also given the liners L3-1 and L3-2.

Here, in the stem slide device according to the first embodiment, when the stem slide table 73 reaches the descent limit and the mechanical stop operates, the stem slide table 73 is pushed to the stem vertical movement support 71 side, whereby deviation of the center axis of the stem 6 from the axis X of the billet holding part C of the container due to wear can be corrected. This utilizes the fact that originally the back surface of the stem slide table 73 is parallel with the surfaces of the liners L1-1 and L1-2 provided at the stem vertical movement support 71 and, when the stem slide table 73 reaches the descent limit, the center axis of the stem 6 matches with the axis X of the billet holding part C of the container in the design.

Therefore, the slide guide members 72-1 and 72-2 facing the side ends E1 and E2 of the stem slide table 73 have hydraulic cylinders 77-1 and 77-2 attached to them. Further, push rods 78-1 and 78-2 driven by the hydraulic cylinders 77-1 and 77-2 are provided. The push rods 78-1 and 78-2 are driven by the hydraulic cylinders 77-1 and 77-2 and push the side ends E1 and E2 of the stem slide table 73 when the fact of the stem slide table 73 being positioned at the descent limit is detected.

By the push rods 78-1 and 78-2 pushing against the side ends E1 and E2 of the stem slide table 73, the clearance formed between the back surface of the stem slide table 73 and the surfaces of the liners L1-1 and L1-2 of the stem vertical movement support 71 is eliminated, the back surface of the stem slide table 73 is pushed against the surfaces of the liners L1-1 and L1-2, and, as a result, vertical shaking of the axis of the stem 6 can be corrected. With this, it is possible to make the center axis of the stem 6 and the axis X of the billet holding part C of the container match and the centering of the stem 6 is simplified.

Figure 2:
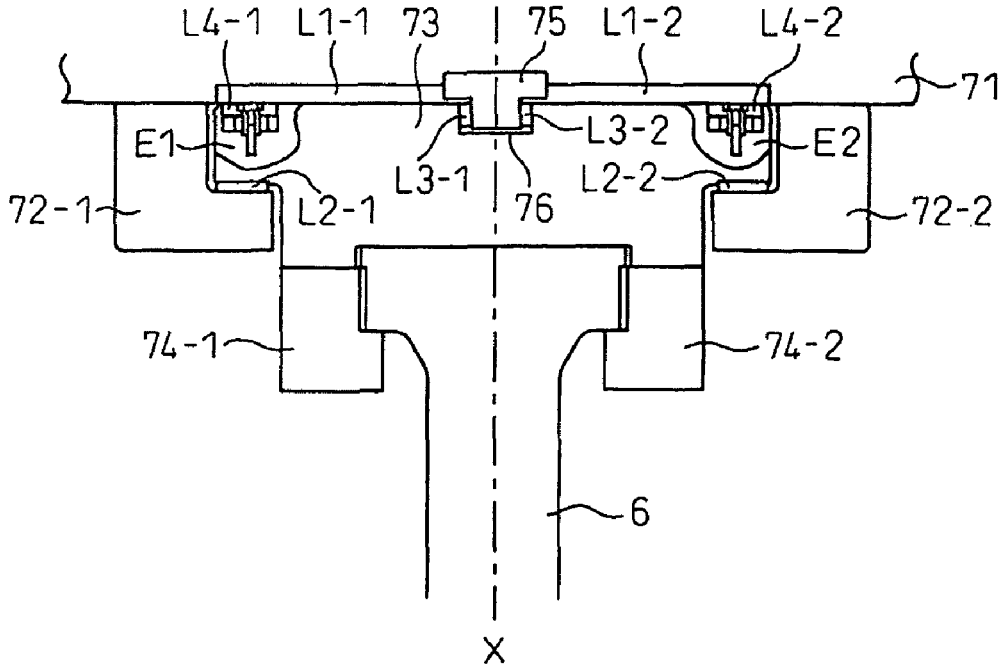
FIG. 2 is a view explaining a second embodiment of a stem slide device in an extrusion press according to the present invention.

Next, FIG. 2 shows a second embodiment of a stem slide device of the present invention. The stem slide device of the second embodiment shown in FIG. 2, like the case of FIG. 1, is expressed by a horizontal cross-section at the position of the stem axis of the stem slide device shown in FIG. 5. Note that the stem slide device shown in FIG. 2 has the same basic configuration as the stem slide device shown in FIG. 5. Parts the same as the stem slide device of FIG. 5 are assigned the same notations.

Here, the stem slide device of the second embodiment of FIG. 2 differs from the case of FIG. 1 in that steady guide mechanisms are provided at the locations of the side ends E1 and E2 of the stem slide table 73. In FIG. 2, the provision of the steady guide mechanisms at the side ends E1 and E2 is shown in the partially cutaway part. Details of the steady guide mechanisms are shown in FIG. 3 though only for the side end E1 side. The steady guide mechanisms are configured the same at both the side ends E1 and E2. In FIG. 3, the steady guide mechanisms are shown by a vertical cross-section.

Figure 3:
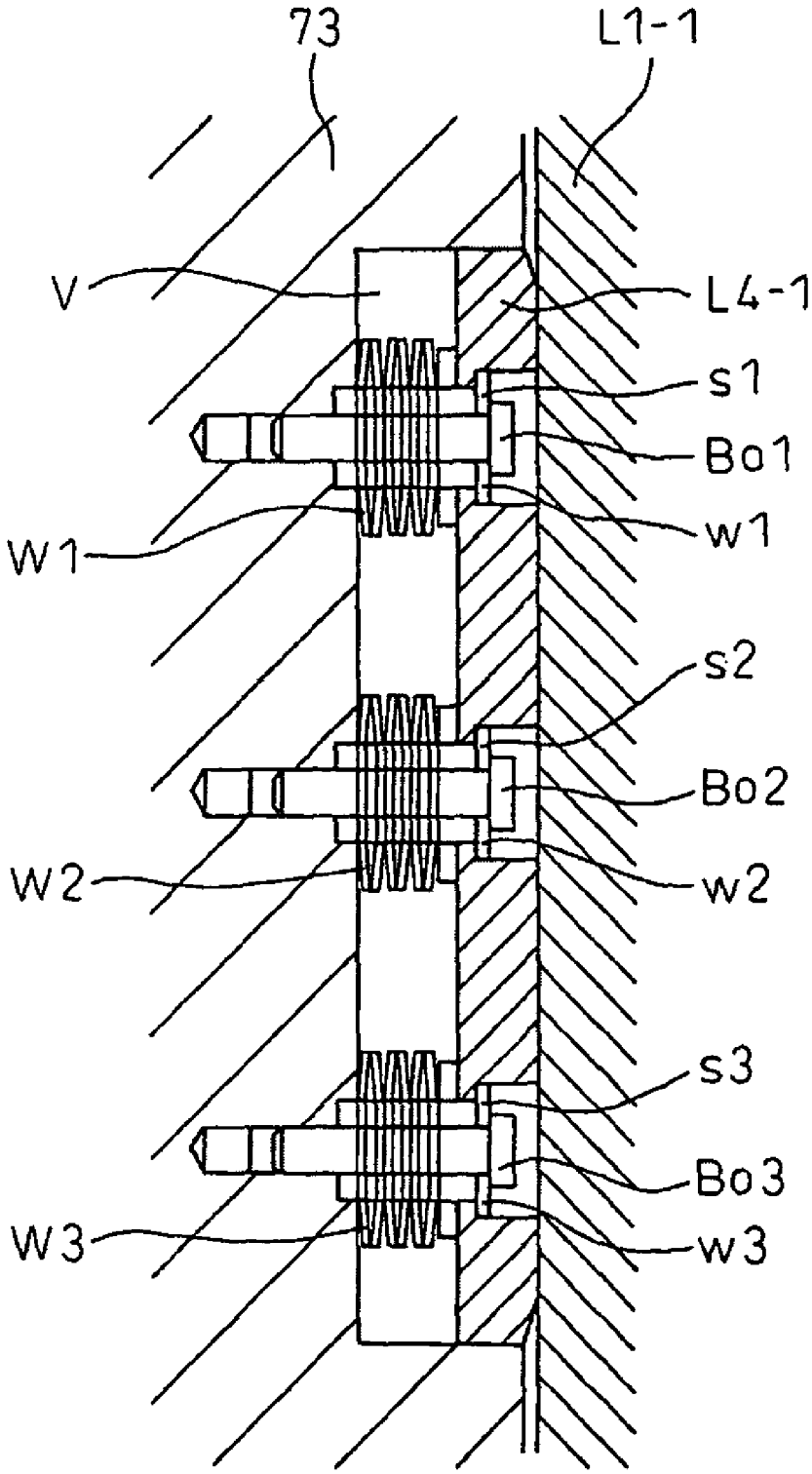
FIG. 3 is an enlarged cross-sectional view explaining principal parts of a slide part in a stem slide device of the second embodiment.

As shown in FIG. 3, the steady guide mechanism at the side end E1 side is basically configured from a liner L4-1, elastic holding members, for example, the plate spring washers W1 to W3, and bolts Bo1 to Bo3. The stem slide table 73 is provided with a groove V able to hold this steady guide mechanism and having a predetermined width and predetermined depth. Inside this groove V, the liner L4-1 is elastically held. This elastic holding is realized by plate spring washers W1 to W3 and bolts Bo1 to Bo3.

The bolts Bo1 to Bo3 fasten plain washers w1 to w3 through sleeves s1 to s3. The plain washers w1 to w3 are provided with holes through which the sleeves s1 to s3 pass with free play. Furthermore, the liner L4-1 is also provided with holes for passing the sleeves s1 to s3 with free play. Therefore, as shown in FIG. 3, the liner L4-1 is pushed outward from the stem slide table 73 by the elasticity of the plate spring washers W1 to W3, but the plain washers w1 to w3 restrict pushing out to the outside.

This liner L4-1, as shown in FIG. 3, sticks out from the back surface of the stem slide D73, pushes against the liner L1-1 of the stem vertical movement support 71, and thereby eliminates rattling when the stem slide table 73 slides along the slide guide member 72-1. Further, between the back surface of the stem slide D73 and the liner L1-1 of the stem vertical movement support 71, a clearance is formed for preventing seizure. This clearance is freely adjusted. Further, the liner L4-1 is fastened by bolts to the stem slide table 73, so replacement of a worn liner is simple.

Note that up to now, the steady guide mechanism was explained focusing on the side end E1 side of the stem slide table 73, but a similar steady guide mechanism may also be provided at the side end E2 side of the stem slide table 73. In particular, providing steady guide mechanisms at both the side ends E1 and E2 of the stem slide table 73 is important in suppressing lateral shaking of the stem 6.

Further, the stem slide device of the first embodiment shown in FIG. 1 may also incorporate the steady guide mechanism in the second embodiment shown in FIG. 2 and FIG. 3. In this case, when the stem slide table 73 being positioned at the descent limit is detected, the drive operations of the hydraulic cylinders 77-1 and 77-2 causes the push rods 78-1 and 78-2 to push the stem slide table 73 against the liners L1-1 and L1-2 of the stem vertical movement support 71, but the liners L4-1 and L4-2 of the steady guide mechanism are elastically held, so receive a reaction force from the liners L1-1 and L1-2 and are pushed back into the groove V of the stem slide table 73. At this time, the steady guide mechanism has no effect on the centering to the axis X for the stem 6.

The invention claimed is:

1. A stem slide device comprising:

a stem slide table to which a stem pushing a billet loaded in a container is horizontally attached, a slide guide member attached to a stem vertical movement support and forming a guide groove with which a side end of said stem slide table is engaged and slides upwardly and downwardly, and a lock unit provided at said slide guide member and pushing a side end of said stem slide table, wherein when said stem slide table is positioned on an upper side of said guide groove, said billet is loaded into said container by a billet loader operating in a space under said stem slide table, formed by upward movement of the stem slide table, and when said stem slide table is positioned at a bottom end of said guide groove, said lock unit is driven to lock said stem slide table, and said stem is held at a position of an axial line of said container.

2. The stem slide device as set forth in claim 1, wherein said guide groove is formed by an inner surface of said slide guide member and a wall surface of a stem vertical movement support attaching said stem slide table facing each other, the side end of said stem slide table sliding between said inner surface and said wall surface, and the side end of said stem slide table is pushed by said lock unit against the wall surface of said stem vertical movement support.

3. The stem slide device as set forth in claim 2, wherein a liner is applied to the inner surface of said slide guide member and the wall surface of said stem vertical movement support.

4. The stem slide device as set forth in any one of claims 1 to 3, wherein the side end of said stem slide table slides along the wall surface of said stem vertical movement support and is provided with a liner member elastically held in a direction pushing against said wall surface.

5. The stem slide device as set forth in claim 4, wherein said liner member is pushed by the wall surface of said stem vertical movement support when said lock unit is driven and a back surface of said stem slide table abuts against a wall surface of said stem vertical movement support.

* * * * *